US006532704B2

(12) United States Patent
Hart

(10) Patent No.: US 6,532,704 B2
(45) Date of Patent: Mar. 18, 2003

(54) BOARD-UP-BUDDY

(76) Inventor: Michael Guynn Hart, 2913 W. Industrial Ave., Midland, TX (US) 79701

( * ) Notice: Subject to any disclaimer, the term of this patent is extended or adjusted under 35 U.S.C. 154(b) by 0 days.

(21) Appl. No.: 09/866,136

(22) Filed: May 25, 2001

(65) Prior Publication Data

US 2003/0033763 A1 Feb. 20, 2003

(51) Int. Cl.[7] ..... E06B 3/26

(52) U.S. Cl. ..... 52/202; 52/278; 52/279; 52/280; 52/656.9; 52/713; 52/127.2; 248/248; 248/220.1; 248/300

(58) Field of Search ..... 52/278, 279, 280, 52/282.4, 656.9, 656.1, 712, 713, 698, 693, 202, 127.2, 287.1, 288.1, 749.1; 248/220.1, 300

(56) References Cited

U.S. PATENT DOCUMENTS

| | | | |
|---|---|---|---|
| 3,286,412 | A | 11/1966 | Greig et al. |
| 3,930,338 | A | 1/1976 | Rood |
| 3,979,796 | A | 9/1976 | Mac Donald |
| 4,562,666 | A | 1/1986 | Young, III |
| 4,938,154 | A | 7/1990 | Watt |
| 5,207,022 | A | 5/1993 | Watt |
| 5,617,674 | A | 4/1997 | Terrill |
| 5,673,883 | A | 10/1997 | Figueroa, Jr. |
| 5,722,206 | A | 3/1998 | Mc Donald |
| 5,832,671 | A | 11/1998 | White |

*Primary Examiner*—Jose V. Chen
*Assistant Examiner*—Chi Q Nguyen

(57) ABSTRACT

A system for boarding up a store front window, and more specifically a corner bracket for use in removably supporting a panel respective an opening formed by a store front frame having corners. The panel temporarily closes the opening while avoiding damage to the frame, and preventing intrusion through the store front frame. The corner bracket has spaced parallel flanges connected by perpendicular load bearing wall members. One bracket is received at each corner of the store front frame and the load bearing wall members bear against adjacent frame members that form a corner. One of the flanges engage an interior surface of the frame while the opposed flange is attached to the panel. This causes the corner bracket to urge the panel against the exterior wall surface of the frame. The panel can be of an area greater than the area defined by the inner periphery of the frame to bring the marginal edge of the panel into engagement with the exterior frame face. Hence the spaced parallel flanges places the perpendicular load bearing wall members in tension and resists both lateral and outward movement of the temporary panel away from the frame. Additionally, this arrangement hides the corner brackets from outside view and therefore nothing is revealed exteriorly of the enclosure that would enable a pedestrian to determine the details of the construction.

6 Claims, 2 Drawing Sheets

BOARD-UP-BUDDY

CROSS-REFERENCE TO RELATED APPLICATIONS

NOT APPLICABLE

STATEMENT REGARDING FEDERALLY SPONSORED RESEARCH OR DEVELOPMENT

NOT APPLICABLE

REFERENCE TO A MICROFICHE APPENDIX

NOT APPLICABLE

BACKGROUND OF THE INVENTION

The present invention comprehends apparatus by which a store front frame that forms a window for an enclosure can temporarily be closed in a new and unusual manner. Store front frames within which a glass panel is supported usually are expensive metal rectangular apparatus having a special U-shaped grove within which an outer marginal edge portion of the glass panel is securely supported in a safe and secure manner. Many store front frames are attractive and may be considered a work of art by the owner so it is only reasonable that never should the frame become defaced. Occasionally, for various reasons, the transparent plate glass panel is broken and must quickly be replaced, or otherwise the contents of the enclosure may be damaged, therefore steps should be taken immediately to discourage intrusion therethrough and to prevent theft or further damage to the enclosure interior.

There are safety regulations and laws that require the plate glass panel in public buildings be treated and rendered safe to the public so that should the glass panel become broken, personal injury is minimized. Accordingly the glass panel is designed to be fragmented into small pieces that are unlikely to cut persons in proximity thereto upon breakage thereof. For this reason the Glazer, when called upon to replace the damaged panel, usually cannot promptly install a replacement glass panel because most heat treated glass panels becomes fragmented upon attempts to cut and properly fit it into a store front frame.

Hence the Glazer must carefully measure and special purchase a new glass panel that is specifically dimensioned to replace the damaged glass panel and which will exactly fit the old frame. In the meanwhile the storefront is open to the elements as well to the marauders and for this reason the opening usually is boarded by securely fastening a makeshift wooden panel within the frame, thereby temporarily closing the opening to prevent intrusion into the building.

This job of boarding up the open window necessitates nailing, drilling, and other mechanical manipulations for improvising a closure member that usually is attached onto the outside of the frame in a manner to make it difficult as possible for intruders to gain access into the building. This improvised boarding up of the frame usually results in unsightly permanent damage to the frame and naturally is most irritating to the owner who heretofore took great pride in the attractive frame. The drilling and nailing not only mars the framework but additional often structurally damages the frame and in some instances the surrounding structure. Furthermore an unprofessional boarded up opening is an advertisement to criminals that the window is damaged and challenges thieves to attempt forcible entrance thereinto for purpose of looting.

Accordingly, it is desirable to provide apparatus and method by which a store front frame can be closed in a superior and more attractive manner than has been possible in the past and which gives the appearance of permanence, all of which makes intrusion therethrough less likely; while at the same time avoiding a reduction to the cosmetics of the frame. Further, by the present invention, the window is rendered secure against these undesirable results in a minimum of time and expense and further the professionalism exhibited by the Glazer and his work product increases the owners confidence while the Glazer is waiting on a new glass panel to be prepared for permanently closing the boarded up window.

PRIOR ART STATEMENT

The following enclosed patents are noted of primary interest and are representative of the available prior patents:

U.S. Pat. Nos. 3,286,412 3,930,338 3,979,796 4,562,666 4,938,154 5,207,022 5,617,674 5,673,883 5,722,206 5,832,671

The following enclosed patents are noted of secondary interest and are included for background information:

U.S. Pat. Nos. 2,772,447 3,616,956 4,206,784 4,335,554 4,913,061 5,125,197 5,343,668 5,937,593

The Figueroa, Jr. Patent, U.S. Pat. No. 5,673,833 and White U.S. Pat. No. 5,832,671 disclose a security closure that extends between opposed faces of a window frame where it is held and presses against opposed window frame members.

The Terrill Patent, U.S. Pat. No. 5,617,674, shows a panel 22 and a cross member 26 held compressed against a door frame to position the panel 22 where it acts as a closure member for the door.

The Watt Patent, U.S. Pat. No. 4,938,154, shows that panels 1 and 2 can close an opening. Steel bars 7 form anchor means by which flexible strap 8 is placed in tension respective to panels 1 and 2.

The McDonald Patent, U.S. Pat. No. 3,979,796, shows a front panel 12 of a false drawer having panel mounting clip 10 secured to panel 12 to engage the face of frame 16. The present concept distinguishes from McDonald by having 90 degree opposed unitary flanges that terminate in spaced relationship to one another and a unitary flange with the opposed legs engaging and securing a closure member as the member is forced against the window frame and thereby prevents entry as well as being tamper proof. Such a concept is not found in the prior patents.

Note that Greig et al, U.S. Pat. No. 3,286,412, discloses frame members 20, 22 having panel 28 secured thereto by spring clip 36.

Watt (U.S. Pat. No. 5,207,022), Young (U.S. Pat. No. 4,562,666), Mcdonald (U.S. Pat. No 5,722,206) and Rood (U.S. Pat. No. 3,930,338) show other prior art examples of a system of attaching a panel to a frame.

BRIEF SUMMARY OF THE INVENTION

This invention is to a system for boarding up a store front window, and more specifically to a corner bracket for use in removably supporting a panel respective an opening formed by a store front frame to temporarily close the opening while avoiding damage to the frame, and preventing intrusion through the store front frame. The corner bracket has spaced parallel flanges connected by perpendicular load bearing wall members. One bracket is received at each corner of the store front frame and the load bearing wall members are positioned to bear against adjacent frame members that form a corner. One of the flanges abuttingly engages an interior surface of the frame; while the opposed flange is attached to the near surface of the temporary panel, so that the corner bracket urges the panel against the exterior wall surface of the frame. Hence. the corner brackets support the panel and forces the marginal edge of the panel into abutting engagement respective the exterior frame face, while the spaced parallel flanges places the perpendicular load bearing wall members in tension and resists outward movement of the temporary panel away from the frame. Furthermore, the load bearing wall members abuttingly engage adjacent inner side walls of the frame to prevent lateral displacement of the temporary panel respective to the frame. The temporary panel can be made of plywood or other relative inexpensive panel material which can be easily cut to dimensions to cover an area slightly greater than the area defined by the inner periphery of the frame so that the marginal edges of the panel overlap the frame. Additionally, this arrangement hides the corner brackets from outside view and therefore nothing is revealed exteriorly of the enclosure that would enable a pedestrian to determine the details of construction other than the few bolt heads that may be used to attach each of the corner brackets to the interior of the temporary panel.

DETAILED DESCRIPTION OF THE INVENTION

Figure 1:
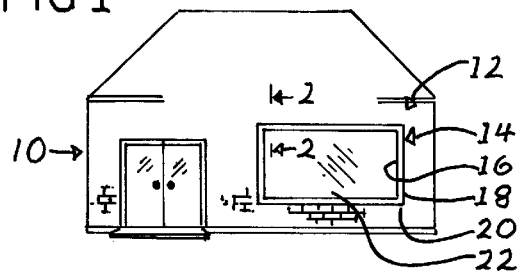
FIG. 1 is an outside perspective view of an enclosure having a prior art window supported on a wall thereof that can use the apparatus of this invention on occasion.

FIG. 1 diagrammatically shows an enclosure, such as a building 10, having a window 12 in the form of a modern store front frame 14, hereinafter referred to simply as a frame 14. Frame 14 defines an opening through one of the sidewalls of the illustrated building 10. Frame 14, as also seen illustrated in FIGS. 2, 3, 6 and 7, preferably is a commercially available extruded aluminum structure, although the invention could advantageously be practiced in conjunction with numerous other frame designs.

Figure 6:
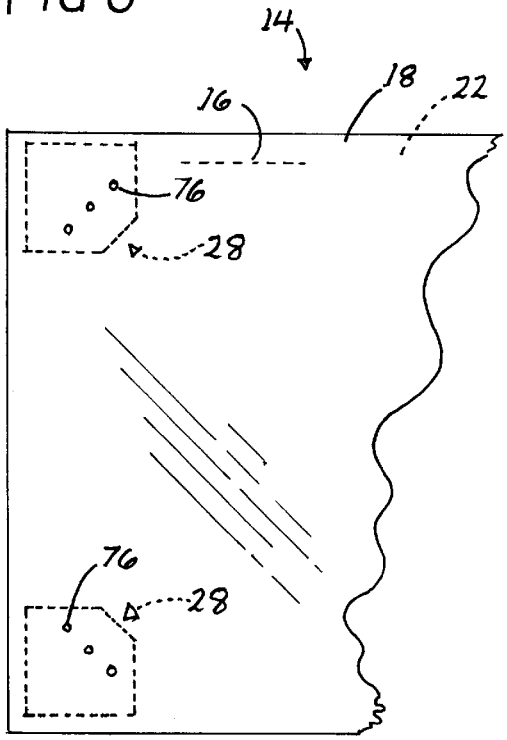
FIG. 6 is a partial elevational view looking from the outside of the closed window of FIG. 3 and discloses an important feature of this invention; and, FIG. 7 is a partial, elevational view looking from the inside of the closed window of FIG. 6 and discloses additional details of this invention.
Figure 7:
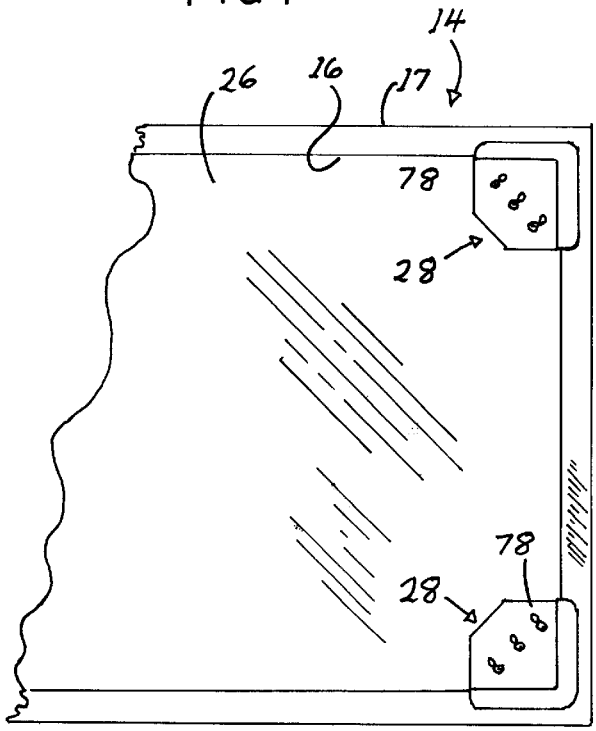

Frame 14 has the usual inner peripheral wall surface 16 opposed to an outer peripheral wall surface 18, and an exterior face 20 opposed to an interior face 22 that defines the width of frame 14. Frame 14 is secured to the building structure by. any suitable prior art means (not shown) so long as the frame 14 is suitably anchored respective to the building sidewall. The inner confronting surfaces 16 of the frame jointly form a rectangular or square geometrical figure as shown in FIGS. 1, 6 and 7.

Figure 2:
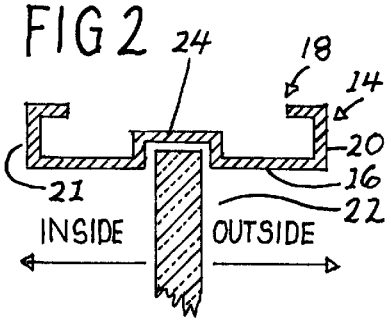
FIG. 2 is an enlarged, detailed, cross-sectional view taken along line 2—2 of FIG. 1; and showing part of the window of FIG. 1.
Figure 3:
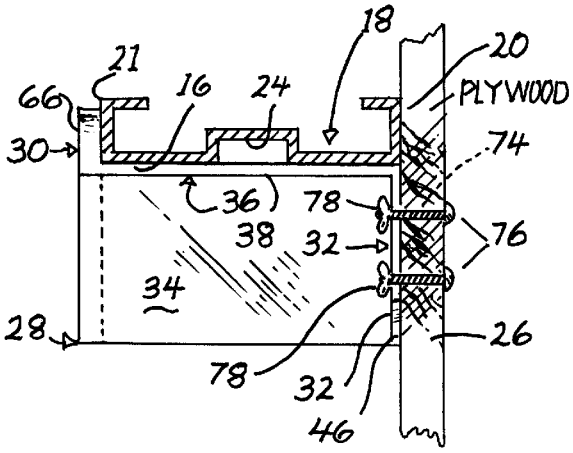
FIG. 3 is a part cross-sectional representation of part of the apparatus disclosed in FIG. 2 and disclosing apparatus made in accordance with the present invention installed thereon.

The opposed marginal edges of a panel of plate glass 22 is captured within the illustrated channel 24 of the frame 14 as illustrated in FIGS. 2 and 3. However, should it become necessary to remove the panel of plate glass 24 from the frame 14 and substitute therefor the temporary panel 26, the outer marginal edges of the temporary panel 26 are brought to bear against the exterior face 20 of the frame as shown in FIGS. 3, 6, and 7 by means of a novel corner bracket 28, herein referred to as a corner bracket 28, or bracket 28 which is made in accordance with this invention. A novel corner bracket 28 is advantageously installed at the corners of the frame where the temporary panel is held removably secured in fixed relation respective the frame in the illustrated manner of FIGS. 3, 6 and 7 of the drawings.

Figure 4:
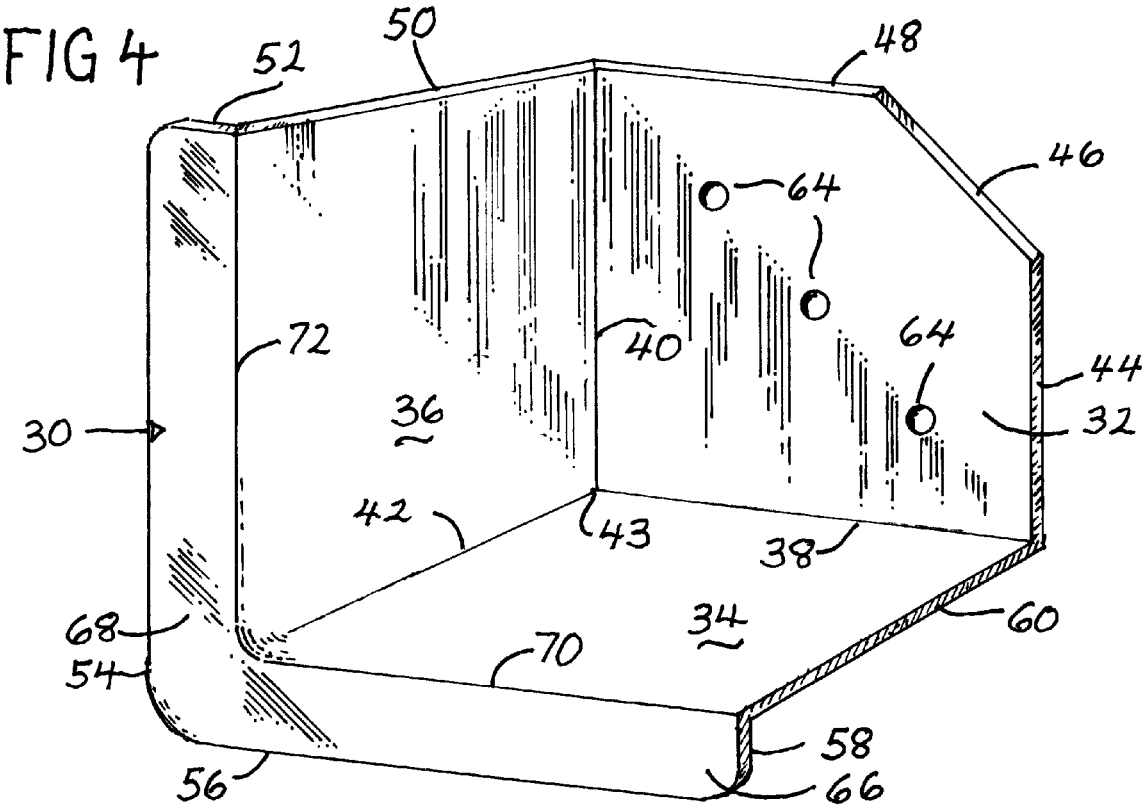
FIG. 4 is an enlarged perspective detailed view of a corner bracket made in accordance with the present invention; and partially disclosed in other figures of the drawings.
Figure 5:
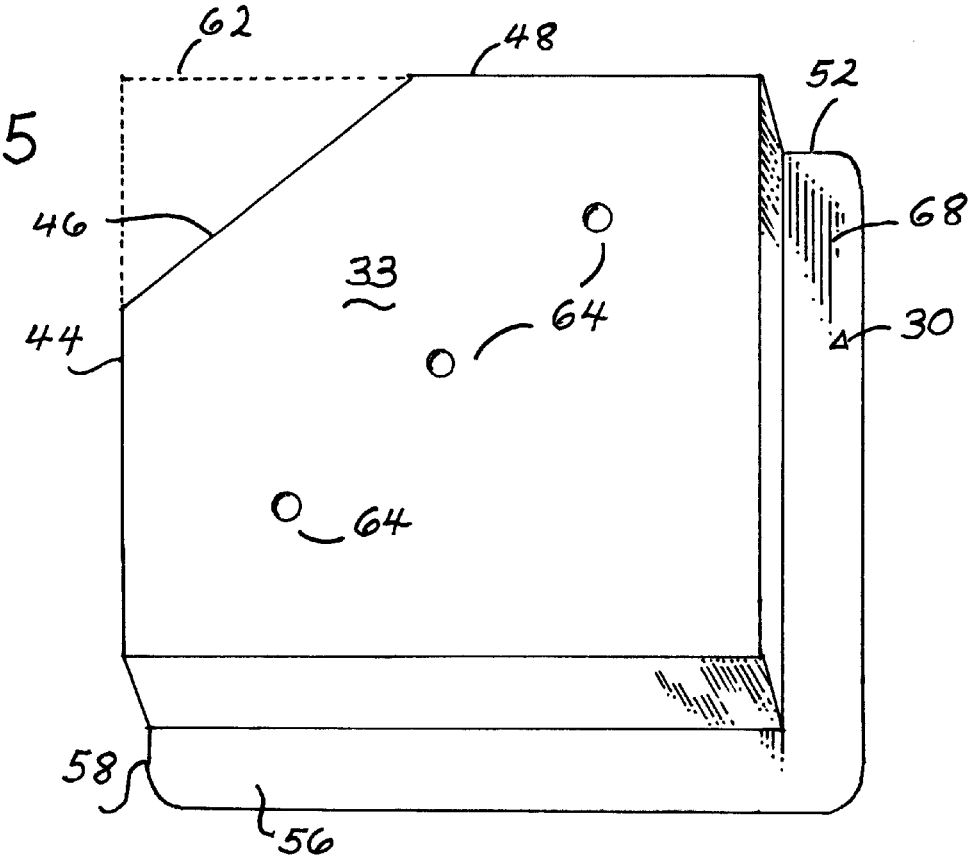
FIG. 5 is another perspective rear view of the corner bracket of FIG. 4, showing additional details of the present invention.

Looking now to FIGS. 4 and 5, which disclose additional details of the bracket 28 of this invention, it will be noted that the bracket 28 has an L shaped interior flange 30 spaced from a far flange 32 which faces towards the exterior when attached to the interior face of the temporary panel 26 in the illustrated manner of FIG. 3. Flanges 30, 32 lay parallel to one another and are spaced apart by tension members 34, 36 which firmly connect the four members 30, 32, 34 and 36 together. Tension members 34, 36. are shown as perpendicularly disposed walls, each wall being attached to and arranged perpendicular to one another and to the before described flanges 30, 32, with there being common edges 38, 40, 42 formed by the joinder of members 32, 34, 36, and with flanges 30, 32 extending in opposed directions from the tension members 34, 36.

This configuration of bracket 28 presents a continuous outer edge portion or small surface area 44, 46, 48, 50, 52, 54, 56, 58, 60, 62 and 64 that extends about the periphery of the bracket and defines the configuration thereof. Numeral 62 is the apex or intersect should edges 44, 48 be extended rather than cut to form edge 46 as shown. Flange 32 is apertured as illustrated at 64. It will be noted that opposed flange 30 has L-shaped perpendicularly disposed legs 66 and 68 that cooperate with tension member 34, 36 to form edges 40, 72. Commercially available carriage bolts 74 have rounded heads 76 at one end thereof that is opposed to wind nut fasteners 78. Bolts 74 extend through apertures or holes 64 that are drilled or extend through panel member 26 in aligned relationship respective the preformed holes 64 that are previously formed in flange 32. An auxiliary "z" member 80 having a flat 82 and bent ends 84, 86 can be installed where large panels are deemed to need additional support.

It will now be appreciated that the illustrated preferred embodiment of this invention is in the form of a corner bracket 28 and preferably is an integral one peace member, made of plastic material, and comprised of members 30, 32, 34 and 36. Each of members 30, 32, 34 and 36 have a specific function for enabling a broken store front glass panel to be temporarily boarded up in a new and unusual manner that provides great utility, prevents intrusion through frame 12, avoids defacing frame 12, and is inexpensive as well as pleasing in appearance.

Briefly, the operation of the boarding up system of this invention is carried out in order to rapidly and inexpensively provide a closure member for a store front frame. Usually this necessity arises because the plate glass window or panel 22 has been broken. After the broken glass has been removed from the frame, the temporary panel 26 is sized to the approximate outer dimensions of frame 12 and held in proper overlapping alignment against the exterior face 20 of frame 12 while a corner bracket 28 is installed at each of the corners of the frame. This is achieved by placing legs 66, 68 of the interior flange 30 of corner bracket 28 against the interior face 21 of frame 12 while holding the far or exterior flange 32 against the near or interior face of temporary panel 26, with the adjacent tension members 34, 36 of each corner bracket 28 bearing against adjacent inner sides 16 of frame 12. Next, holes are drilled in panel 26 at the location indicated by the pre-formed holes 64. The drilled holes are of an appropriate size to accommodate carriage bolts 74 which are inserted through the drilled holes from the exterior side of the panel and extend through the far flange 32 of the corner bracket. Next the wing nuts 78 are torqued onto the threaded end of carriage bolts 74 which places the tension members 34, 36 under sufficient tension force to secure the temporary panel 26 against the exterior side of frame 12 to cover the opening formed within frame 12 and thereby temporarily close the opening. This procedure removably supports temporary panel 26 securely against the exterior side of frame 26 to restrict lateral movement between the panel and frame and thereby prevents intrusion through the store front frame. The corner brackets 28 positioned at each corner of the frame hold the panel in place and resists lateral movement respective the frame by the friction developed between the confronting faces of the frame and flanges as well as the abutting relationship between confronting faces of the tension members and the inner frame faces. The spaced parallel flanges as well as the perpendicular tension members are all load bearing members and contribute to the boarding up system.

Those skilled in the art, having digested the essence of this entire disclosure. will envision certain modifications which could be effected thereon while still remaining within the scope of the invention; as for example, enlarging the flanges to extend towards one another and connected to the spaced flanges 30, 32; or as another example making the members 34, 36 curve towards one another in proximity of the edge 42; as well as extending the width of flange 30 to define a triangle whose hypotenuse extends into proximity of the far ends of the flanges. According the metes and bounds of this invention is deemed to lie within the scope of the appended claims found herein.

CATALOG OF PARTS

The following catalog of parts is offered for the Examiners convenience and probably will be cancelled upon allowance of this Patent Application contingent upon the recall of the aged Patent Agent of record.

10 enclosure such as a building
12 window
14 store front frame defines an opening
16 inner peripheral wall of 14
18 outer peripheral wall of 14
20 exterior face of 14
21 interior face of 14
22 plate glass
24 channel capures edge of glass
26 plywood temporary panel
28 corner bracket of this invention
30 interior flange of 28
32 far flange
34 tension or load bearing wall members are perpendicular walls 34, 36
36 tension or load bearing wall members are perpendicular to 34, 36
38 edge formed by joinder of members 32, 34
40 edge formed by joinder members 32, 36
42 edge formed by joinder of members 34, 36
43 apex of 38, 40, 42
44 terminal edge // and spaced from 40
46 terminal edge oblique and spaced from 38, 40
48 terminal edge // and spaced from 38
50 edge formed by member 36
52 terminal edge formed by member 30
54 terminal edge formed by members 68
56 terminal edge formed by member 66
58 edge formed by members 66
60 terminal end of member 34
62 terminal end of member 34
64 apertured
66 leg of 30
68 flange part of 30
70 edage 66 to 34
72 edge of 36
74 through bolt
76 bolt round head
78 wing-nut
80 aux "z" member
82 aux reinforcing splice
84 bent edge
86 bent edge

I claim as my invention:

1. In a store front frame having adjacent frame members that form corners, and having an inner surface forming an opening within which a glass panel can be supported, and further having an interior side wall opposed to an exterior side wall, the combination with said store front frame of a corner bracket that can be removably positioned against adjacent inner surfaces at each frame corner for supporting a temporary panel having near and far opposed surfaces and which can be substituted for a glass panel to close the frame opening while avoiding damage to the store front frame and preventing intrusion through the store front frame opening;

each said corner bracket having load bearing wall members arranged perpendicular to one another; spaced parallel flanges attached to opposed edges of the load bearing wall members; wherein each of the load bearing wall members, respectively, bear against the inner surfaces of adjacent frame members, respectively, that form a corner;

one of the spaced parallel flanges includes legs arranged perpendicularly respective one another, respectively, for abuttingly engaging adjacent interior surfaces, respectively, of a corner of the frame, while the other of the parallel flanges is attachable to the near surface of the temporary panel, whereupon the corner bracket urges the temporary panel near surface against the exterior surface of the frame; whereby:

a marginal near surface of the temporary panel is forced into abutting engagement respective the exterior frame surface while the load bearing wall members resist outward movement of the panel away from the frame exterior surface and places the load bearing wall members under tension and the temporary panel hides the corner brackets when viewed from the far side of the store front temporary panel.

2. The combination of claim 1 wherein the near face of the temporary panel is affixed to the other flange by attachment means, including bolts; and wherein the store front frame is a quadrilateral having a corner bracket installed on the frame at each of the corners for securing the near face of the temporary panel to the exterior face of the frame.

3. In a store front frame within which a glass panel can be mounted, the frame having an interior side opposed to an exterior side and is formed by vertical and horizontal opposed frame members wherein adjacent frame members form corners, the improvement comprising:

a corner bracket for removably supporting a temporary panel against the exterior side of the frame to cover an opening formed within the frame and thereby temporarily close the opening and prevent intrusion through the store front frame;

said corner bracket having spaced parallel flanges integrally connected to a pair of load bearing wall members, the wall members being arranged perpendicular respective one another and joined together along a common edge;

said spaced parallel flanges are attached to and extend in opposition from said pair of load bearing wall members;

one of said spaced parallel flanges comprises two integral members arranged perpendicular respective one another with the one of the two integral members being.attached to one of the load bearing wall members and the other of said two integral members being attached to the other of said load bearing wall members; the other of the parallel flanges is attached to both of the load bearing wall members;

said wall members having opposed edges that terminate in fixed relationship respective to said spaced parallel flanges.

4. The corner bracket of claim 3, wherein said one of said perpendicular legs engages one adjacent frame members and the other of said perpendicular legs engages the other of the adjacent frame members.

5. The corner bracket of claim 3 wherein the near face of the temporary panel is affixed to the far face of the opposed flange by attachment means, including bolts.

6. A system for boarding up a store front window frame within which a glass panel can be mounted, the frame having vertical and horizontal opposed members to form corners, the members having an interior face opposed to an exterior face; the improvement comprising:

a corner bracket positioned at each corner for removably supporting a temporary panel against the exterior face of the frame to cover an opening formed within the frame and thereby temporarily close the opening and prevent intrusion through the store front frame;

said corner bracket having spaced parallel flanges connected by adjacent perpendicular load bearing wall members which are joined together along common edges;

said spaced parallel flanges are attached to and extend in opposition from said load bearing wall members;

one of said spaced parallel flanges has perpendicular legs with one leg thereof being attached to one of the load bearing wall members and the other of said perpendicular legs being attached to the other of said load bearing wall members; and the other of said spaced parallel flanges is attached to both load bearing wall members;

said wall members having opposed edges that terminate in fixed relationship respective to said spaced parallel flanges.

* * * * *